United States Patent [19]

Haemer

[11] 4,015,036

[45] * Mar. 29, 1977

[54] BONDED CARPETING

[75] Inventor: Laurence F. Haemer, Fairfield, N.J.

[73] Assignee: Congoleum Corporation, Kearny, N.J.

[ * ] Notice: The portion of the term of this patent subsequent to Mar. 30, 1993, has been disclaimed.

[22] Filed: Feb. 17, 1976

[21] Appl. No.: 658,746

Related U.S. Application Data

[63] Continuation-in-part of Ser. No. 444,058, Feb. 20, 1974, Pat. No. 3,947,306.

[52] U.S. Cl. ..... 428/88; 156/72; 156/169; 156/173; 156/174; 156/250; 156/251; 428/89; 428/92; 428/93; 428/95

[51] Int. Cl.[2] ..... B32B 5/00

[58] Field of Search ..... 428/88, 89, 92, 93, 428/95; 156/169, 72, 173, 174, 250, 251

[56] References Cited

UNITED STATES PATENTS

| | | | |
|---|---|---|---|
| 2,344,537 | 3/1944 | Cone | 428/93 |
| 3,271,216 | 9/1966 | Koller | 428/93 |
| 3,574,107 | 4/1971 | Hurka | 428/93 |
| 3,947,306 | 3/1976 | Haemer | 428/95 |

*Primary Examiner*—Marion E. McCamish
*Attorney, Agent, or Firm*—Richard T. Laughlin

[57] ABSTRACT

A method for producing carpeting of a type having pile yarns adhesively bonded to a backing which comprises providing a thin flexible core member having longitudinal and transverse axes, winding a continuous yarn around the core member in a direction perpendicular to the longitudinal axis so as to form a plurality of elongated loops conforming to the cross-sectional configuration of the core member, positioning the core member having the yarn wound thereon on a backing sheet so that the longitudinal axis is parallel to the sheet and the transverse axis is perpendicular to the sheet and so that one end of each of the loops contacts the backing sheet, adhering the end of the loops contacting the backing sheet to the backing sheet, cutting the other ends of the loops, and removing the core member. Carpeting characterized by good register between different colors and different heights with a high degree of flexibility in the design pattern is obtained by this method.

18 Claims, 15 Drawing Figures

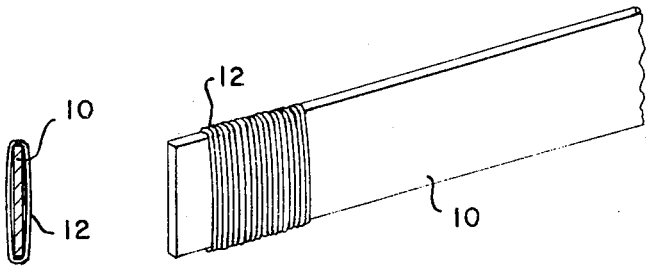
Fig. 2
Fig. 1
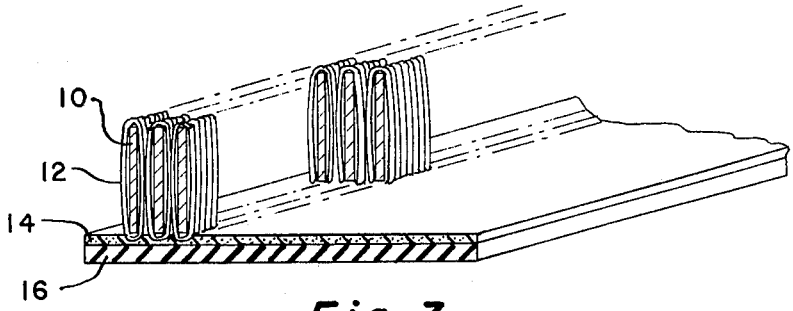
Fig. 3
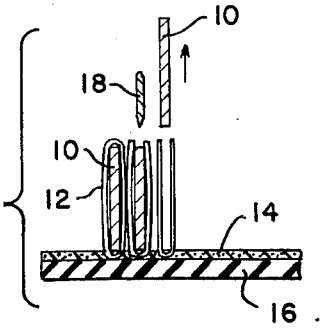
Fig. 4
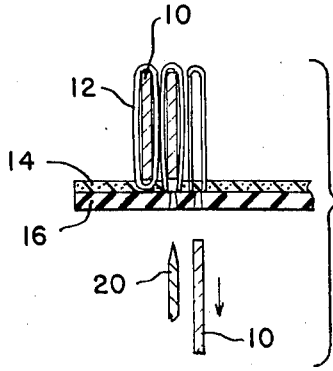
Fig. 5
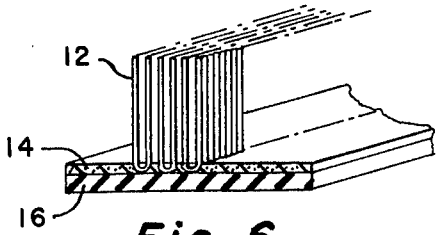
Fig. 6
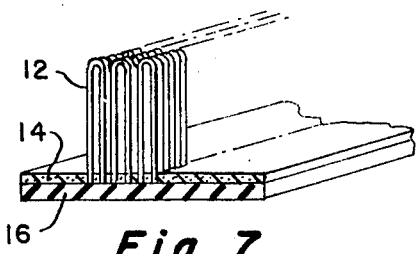
Fig. 7

BONDED CARPETING

CROSS-REFERENCE TO RELATED APPLICATIONS

This application is a continuation-in-part of copending application Ser. No. 444,058, filed Feb. 20, 1974, now U.S. Pat. No. 3,947,306 issued Mar. 30, 1976.

This invention relates to the method of producing pile carpeting, and more particularly, the invention relates to a method for producing bonded carpeting and the carpeting produced thereby.

The most common type of carpeting presently available is the so-called "tufted" carpeting. Such carpeting consists of typically a woven backing sheet having piles or tufts of yarn secured thereto. One end of the tufts is generally secured to the backing sheet, while the other end extends through the backing sheet and a desired distance above the backing sheet to serve as the visible portion of the carpet. Such carpeting is popular particularly from the standpoint of ease of manufacture. The manufacture of such carpeting is carried out on a machine which uses to push the yarn through the backing sheet, similarly to weaving, leaving a loop or tuft projecting up through the sheet.

Tufted carpeting may be given different decorative appearances by a number of techniques. Typically, the yarn used for the production of such carpeting is dyed and may be dyed before the carpeting is made or after the carpeting is made by padding or other dyeing techniques.

Loops are easily formed with a continuous yarn being needled to the backing sheet, and thus, loop-pile carpeting is formed. If these loops are then cut, "cut-pile" carpeting is produced.

The type carpeting may be further enhanced from a decorative standpoint by treating certain of the yarns in a predetermined pattern with a material which causes shrinking of the yarns contacted therewith, thereby producing a sculptured or textured appearance on the surface of the carpeting. The treating materials may be applied simultaneously with dyes for producing a sculptured appearance in register with different color patterns.

Bonded carpeting does not use a backing sheet which is needled with the yarn, but instead, carries an adhesive substance which bonds the yarns to the backing sheet. Bonded carpeting may be characterized by two major categories:

1. Single end implantation, and
2. Multiple fold implantation

Single end implantation refers to a single strand of yarn which is implanted on an adhesive backing, while multiple fold implantation is characterized by a folding or pleating of the yarns to a wavy configuration with subsequent implantation of the bottoms of the waves in the adhesive backing.

Many variations of each of these two types of bonding techniques are found in the prior art, and they suffer from many disadvantages. For example, the loop pile which may be formed by a multiple fold implantation process results in a single, continuous yarn being used for many loops. Thus, if one loop is snagged, the yarn may pull out from the entire carpeting. Single end implantation generally requires more complex machinery, and thus, the commercial feasibility of such systems is reduced.

Another disadvantage to prior art carpeting is the difficulty of producing carpeting which has different colored yarns and yarns of differing heights to give a relief texture to the surface. Particularly, the difficulty has arisen when trying to obtain carpeting where the color pattern is in register with the relief pattern.

In the past, attempts have been made to use computer programmed looms to weave yarns of different colors in different manners to achieve the register of the color with the relief, but the complexity of such systems renders their usage economically unfeasible. Other attempts have been to dye the woven carpeting while simultaneously shrinking in certain area, but this too has met with little success.

The present invention provides a versatile method for producing bonded carpeting which is not, strictly speaking, of either the single end implantation type, nor the multiple fold type, but may be broadly considered as a hybrid of these two prior art methods of bonded carpet production.

The method according to the present invention produces carpeting and is capable of being used to produce greater versatility in the colors, types of yarns, and relief appearance in the finished product. Thus, different yarns such as wool, nylon etc., may be combined to a single carpeting and yarn having different colors along its length or different yarns of different colors may be used in the same carpeting. The pile of the carpeting may even have different colors along its length to produce novel effects. The process may be carried out using pre-dyed, such as solution dyed yarns in a predetermined pattern or griege yarn may be used initially and printed with the desired colors at a subsequent intermediate step. Likewise, different textures of yarn may be used such as shiny and dull yarns, bulky yarns, and the like. In all cases, the carpeting produced can have different colors, textures, types of yarns, etc., in exact register with other colors, with yarn heights, etc.

Accordingly, it is a primary object of this invention to provide an improved method for the production of bonded carpeting.

Another object of this invention is to provide a method for producing bonded carpeting with greatly improved versatility.

A further object of this invention is to provide a method for producing bonded carpeting of either the loop-pile or cutpile types.

Still another object of this invention is to provide a method for producing bonded carpeting which may have a sculptured appearance.

Still a further object of this invention is to provide a method for producing bonded carpeting which may utilize different colored yarns in a given row of piles.

Yet another object of this invention is to provide a method for producing bonded carpeting which may be dyed with a number of different dyeing techniques to permit great versatility in producing carpeting having greater appeal.

Still another object of this invention is to provide a method for producing bonded carpeting which does not require complex machinery for carrying out the method.

Yet a further object of this invention is to provide a method for producing carpeting wherein the yarn may be printed with dyes to produce any desired pattern.

Still a further object of this invention is to provide an improved method for producing sculptured carpeting having a dyed pattern in register with the sculpturing.

These and other objects and advantages of this invention will become apparent when considered in light of the following description and claims when taken together with the accompanying drawings in which:

FIG. 1 is a perspective view of one of the core elements used in the present invention;

FIG. 2 is an end view of the element of FIG. 1;

FIG. 3 is a perspective view showing the assembly of the core elements of FIG. 1 to a backing sheet;

FIG. 4 is a schematic view illustrating the removal of the core element;

FIG. 5 is a schematic illustration showing an alternate method for removing the core element;

FIG. 6 is a perspective view of a section of carpeting produced from FIG. 4;

FIG. 7 is a view similar to FIG. 6, however showing carpeting produced according to FIG. 5.

DESCRIPTION OF FIGS. 1–3

Figure 9:
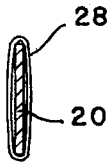
FIG. 9 is an end view of the element of FIG. 8.

With reference now to FIGS. 1–3, a core element 10 is shown. Element 10 is a thin, flexible strip of metal or other suitably strong material. Typically, the strip would be approximately ½ to 1 inch high and sufficiently thin to provide good flexibility with the thickness being dependent upon the particular material of the core element. The element 10 may be of any desired length such as for example, 100 feet or more, and may be wound on a spool for storage prior to use.

A continuous yarn 12 is wound around the core member 10 in a continuous fashion as shown, covering substantially the entire length thereof. The yarn need not be wound extremely tight, but should be uniformally wound so that it will retain its position and shape on the element 10.

The strip 10 with the yarn 12 wound thereon may also be coiled on a spool for storage purposes prior to being made into a carpet.

A plurality of strips 10 having yarn 12 wound thereon are prepared and the number of strips required will depend on the width of the carpeting and the spacing between the tufts across this width. The spacing between adjacent wraps of yarn on the element 10 controls the spacing of the tufts in the longitudinal direction of carpeting.

After the strips have been wound with the yarn, the yarn may be printed with dyes to produce any desired pattern. The pattern may be in register on adjacent strips or may be random, or may be merely a solid color. It is also possible to print different colors at different heights of the pile producing an effect similar to space dyeing of yarn, but with the design being reproducible rather than random.

The elements 10 having the yarn 12 wound thereon are then placed with their transverse axis vertical and their longitudinal axes horizontal so that one of the edges of the element 10 contacts an adhesive material 14 on a backing sheet 16 so that the bottom of the loops of the yarn 12 around the core 10 is embedded in the adhesive 14. A plurality of the core elements 10 are positioned in a parallel manner on the adhesive coated backing in a manner shown in FIG. 3. Although only three core elements are shown in FIG. 3, it is understood that a sufficient number of such elements is used to cover the width of the backing 16 at the desired spacing.

The adhesive used is not critical to this invention, however, it may preferably be a hot extruded plastic sheet, a plastisol which is subsequently gelled and fused, a hot melt coating, a foam which is subsequently gelled and cured, etc., depending upon the type of backing desired. The adhesive and the backing need not be separate elements since if a thermoplastic material is used as the backing, it may likewise serve as the adhesive.

DESCRIPTION OF FIGS. 4–7

In order to remove the core elements 10, it is necessary that the yarn 12 which is wrapped therearound be severed. In order to accomplish this, the carpeting may be passed beneath a suitable knife 18 as seen in FIG. 4 which cuts the tops of the loops of the yarn 12, after which the core elements 10 may be easily removed. In this manner, a "cut-pile" carpeting as seen in FIG. 6 is produced.

Alternately, if a loop pile carpeting is desired, the bottoms of the loops of the yarn 10 are severed by a knife 20 which passes through the backing sheet 16 and the adhesive layer 14 to sever the yarn. Subsequently, the core element 10 is withdrawn through the backing sheet. For this embodiment, a thermoplastic backing sheet is used, the cuts are resealed by reheating the backing to fuse it together. Alternatively, the cuts may be resealed by applying an additional layer of backing material and adhesively securing it or fusing it to the original backing sheet.

In this embodiment, a loop pile type carpeting as seen in FIG. 7 is produced. Whereas in prior art types of loop pile carpeting, the loops are formed from a continuous yarn, the loops formed according to the present invention are individual, and thus, snagging of one loop will only pull out that loop, and no others. This is a distinct advantage over prior art loop pile carpeting, either of the bonded or tufted type.

DESCRIPTION OF THE ALTERNATE EMBODIMENT OF FIGS. 8–12

Since it is apparent that the height of the pile of the carpeting in all embodiments is essentially equal to the width of the core elements 10, and thus the pile height may vary according to the desired type of carpeting being produced, a sculptured pile carpet may be produced by this invention.

Figure 8:
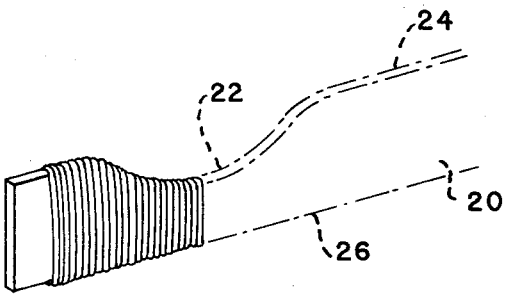
FIG. 8 is a perspective view of an alternate core member used in this invention.

FIG. 8 discloses an alternate embodiment of this invention wherein a core element 20 is provided and has a section 22 of reduced height. The top edge 24 may be patterned to an extent desired, but the bottom edge 26 should be substantially straight. Yarn 28 is wound continuously around the core element 20 in a manner similar to that of FIG. 1 and extends from one end of the strip to the other.

Figure 10:
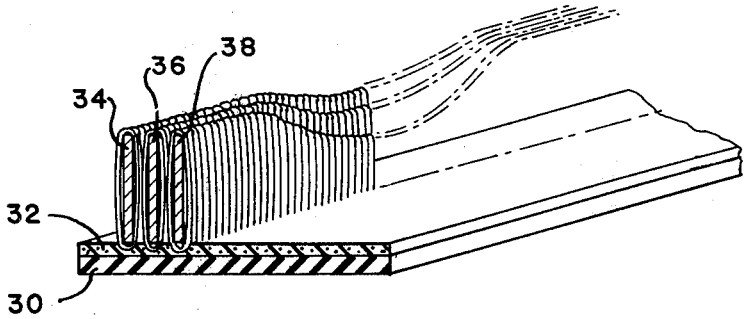
FIG. 10 is a perspective view of the plurality of core members similar to FIG. 8 in assembled relationship.

A plurality of yarn-wound strips are then assembled in a manner similar to that of FIG. 3. As seen in FIG. 10, a backing sheet 30 is provided with an adhesive coating 32, but clearly, the backing sheet and adhesive may be an integral single layer component as discussed previously. A plurality of different core elements 34, 36 and 38 are brought into an assembled relationship as shown in FIG. 10, and pressed into the adhesive material so that the bottoms of the loops of yarn 28 are pressed into the adhesive by the straight edges of the core elements and embedded therein.

Figure 11:
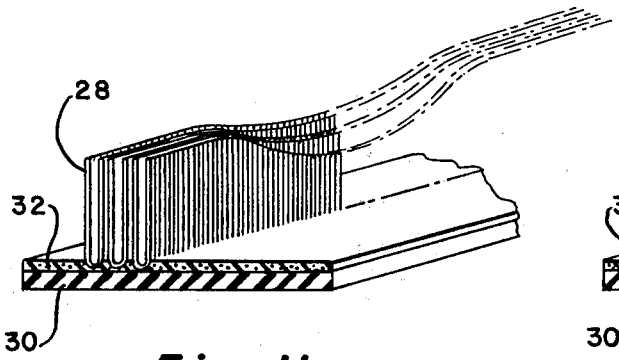
FIG. 11 is a perspective view of one type of carpeting made according to FIG. 10.
Figure 12:
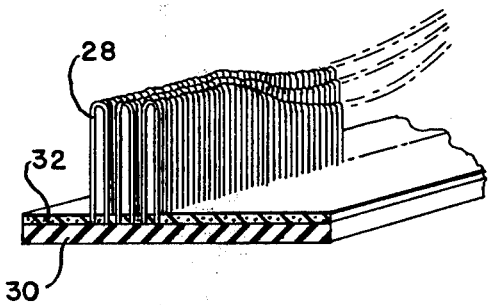
FIG. 12 is a perspective view of a second type of carpeting made from the assembly of FIG. 10.

Next, after the adhesive has set, the loops of the yarn around the core elements 34, 36 and 38 are severed either at the top of the loops in a manner similar to that of FIG. 4, or at the bottoms of the loops in a manner similar to that of FIG. 5. The resultant products are shown in FIGS. 11 and 12, respectively, which disclose a cut pile or loop pile textured or sculptured carpeting.

It is also possible to use pre-dyed yarns for winding on the core elements. Also, several different yarns can be used on the same core element retaining the colors which do not show at a particular spot near the base of the core element and interchanging the winding yarn colors as desired. Thus, two or more different colored yarns could be carried on the core elements at a given time and all or less than all of the yarns would be wound about the element at a particular point.

With the possible variations in the heights of the core elements along their length, and the ease of dyeing the yarns in different manners, great variety may be achieved in the carpeting produced according to the present invention.

A further advantage of the present invention arises when dyeing the yarns after they have been wound upon the core element strips. Since only the thickness of the yarn as opposed to the length of the pile, has to be penetrated by the dye, there is no limitation on pile height as there is present printing methods. Further, this method also allows printing a given tuft of pile with different colors and different heights of the pile in a reproducible pattern, thereby permitting production of effects not available by present techniques.

Another significant advantage of this embodiment is that the carpeting may be produced with a printed dyed pattern in good register with the sculpturing. This is particularly easy to do if sharp shouldered contours are used for the sculptured effect since the shoulders can act as registration points for the printing of the dye.

Further, soft bulky yarns which could not be tufted can be used in the present process, since the tension required in winding on the forms is much less than that required to tuft a heavy yarn.

Figure 13:
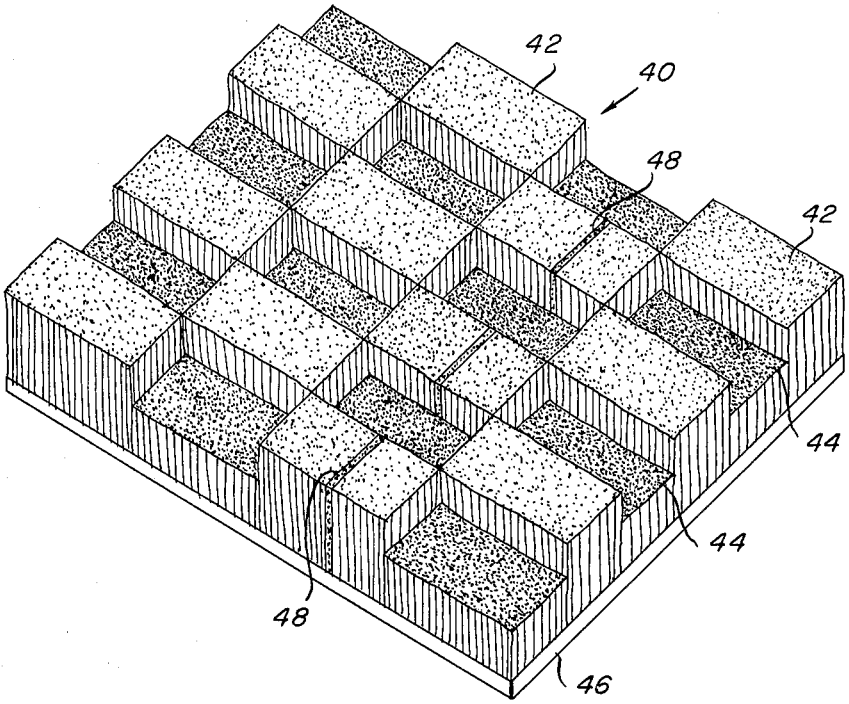
FIG. 13 is a perspective view of a novel type carpeting according to the present invention.

Referring now to FIG. 13, a piece of carpeting generally designated 40 is illustrated. The carpeting is seen to include higher pile areas 42 and lower pile areas 44, all of which are bonded to a backing sheet 46 by either of the techniques previously described. In one embodiment, the higher areas 42 of pile would be of a first color, and the lower pile areas 44 would be of a second different color and as can be seen, the result in this example would be a checker board-type appearance and relief to the carpeting.

For a further variation, the low pile areas 44 may be formed from a relatively bulky yarn, and the higher pile areas 42 may be formed from a less bulky yarn. Alternatively, the lower pile areas may be formed from, for example, a nylon yarn, and the higher pile areas 42 may be formed from an acrylic yarn.

To provide even further versatility, the higher pile areas 42 may also include at predetermined locations stripes 48 of a yarn similar in color and/or texture to the yarns or colors forming the lower pile areas 44.

Figure 14:
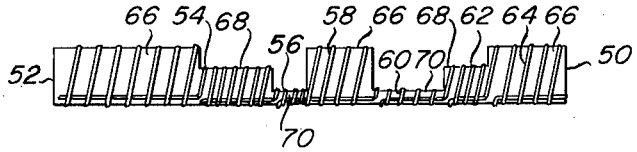
FIG. 14 is a schematic view illustrating the use of two different yarns according to the present invention.

FIG. 14 illustrates a technique which may be used to form a piece of capeting similar in nature to that shown in FIG. 13. A strip 50 having the desired cross-sectional thickness is provided, and the yarn is wound thereon. For example, a first yarn 52 is wound on the left most portion, a second yarn 54 is wound on the next portion, a third yarn 56 is wound on the third portion, a fourth yarn is wound on the next succeeding portion, and in a like manner, yarns 60, 62 and 64 may be wound on succeeding portions. Obviously, if desired, yarn 52 could be continued from the left most portion of strip 50 at the base of the strip and other under the subsequent windings and then re-emerge in place of yarn 58. In this manner, a single yarn may be used in the highest portion 66, a second yarn of a different color may be used in the portions of intermediate height 68 and still a third yarn could be used in the lowest portions 70 of the strip 50.

Of course it is readily apparent when the term "different yarn" is used, this may mean that the yarns differ in color, bulk, texture, composition, or any combination of these.

Figure 15:
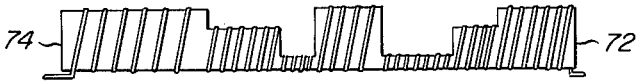
FIG. 15 is a schematic view similar to FIG. 14 but showing the use of a single yarn.

FIG. 15 is an illustration similar to FIG. 14 and showing a strip 72 which has but a single yarn 74 wound thereon the entire length of strip 72. In producing carpeting from such a strip, while each strip has but a single yarn thereon, adjacent strips may be of different yarns, and even the same yarn on a given strip may be dyed in different colors. The different color dyeing may be along the length of the strip or it may be at different heights on the strip to produce novel effects. An advantage is readily apparent in this technique, in that during the dyeing of conventional carpeting, the dye must penetrate the entire length of the tuft since the dye is applied perpendicular to the plane of the carpet, but in the present case, the dye need only penetrate the thickness of the yarn and the resultant dyeing is far more uniform from top to bottom. Thus, particularly, shag carpeting which is difficult to print by conventional means may be patterned by this technique. Likewise, opposite sides of the strip may be printed in the same or in different colors.

It is thus readily apparent that the design possibilities for carpeting according to the present invention are virtually unlimited, and new and novel effects not heretofore attainable may be achieved according to the present invention.

It will be readily apparent that regardless of which technique or design is used, the resultant carpet will be one in which the tufts of yarn will be in a row, and within each row the tufts will be individual and unconnected to any adjacent tuft, either in the same row or in other rows. Likewise, the tufts will have a U-shaped configuration and lie substantially within a plane perpendicular to the direction of the row. Additionally in the case of loop pile carpeting, since the tufts were originally part of a helix, the ends of each loop will be slightly deflected on opposite sides of the plane, yet the entire loop will still lie substantially within the perpendicular plane.

While this invention has been described, it will be understood that it is capable of further modification, and this application is intended to cover any variations, uses and/or adaptations of the invention following in general, the principle of the invention and including such departures from the present disclosure as come within known or customary practice in the art to which the invention pertains, and as may be applied to the essential features hereinbefore set forth, as fall within the scope of the invention or the limits of the appended claims.

What is claimed is:

1. A method for producing carpeting of the type having pile yarns adhesively secured to a backing comprising:

a. providing a thin flexible core member having longitudinal and transverse axes, one of the longitudinally extending edges of said core member being substantially straight and parallel to said longitudinal axis, the other of the longitudinally extending edges being configured such that the width of said core member differs therealong, b. said core member having a first region of a first width and a second region of another width less than said first width, c. winding a yarn around said core member substantially perpendicularly to said longitudinal axis so as to form a plurality of loops conforming in height to the width of said core member, d. dyeing said loops at said first width region a first color and dyeing said loops at said second width region a second color different from said first color e. positioning a plurality of said core member having yarn wound thereon on a backing sheet so that said longitudinal axis is parallel to said sheet and said transverse axis is perpendicular to said sheet and the ends of said loops adjacent said one of said longitudinal edges contacts said backing sheet, f. adhering the ends of said loops adjacent said one of said longitudinal edges to said backing sheet, g. cutting one end of each of said loops, and h. removing said core member, i. thereby producing carpeting having a sculpture pattern in register with a color pattern.

2. A method as in claim 1 and including:

dyeing the yarn on one side of said core member a color different from the yarn color on the other side of said core member.

3. A method as in claim 1 and includng:

a. providing said core member with a region having a third region of a width less than said first region and different from said second region, b. dyeing the loops of said third region a third color different from said first and second colors.

4. A method as in claim 1 and including:

dyeing said loops different colors along the height thereof.

5. A method for producing carpeting of the type having pile yarns adhesively secured to a backing comprising:

a. providing a thin flexible core member having longitudinal and transverse axes, one of the longitudinal extending edges of said core member being substantially straight and parallel to said longitudinal axis, the other of the longitudinally extending edges being configured such that the width of said core member differs therealong, b. said core member having a first region of a first width and a second region of another width less than said first width, c. winding a first yarn around said first width region, d. winding a second yarn around said second width region, e. positioning a plurality of said core members having yarn wound thereon on a backing sheet so that said longitudinal axis is parallel to said sheet and said transverse axis is perpendicular to said sheet and the ends of said loops adjacent said one of said longitudinal edges contacts said backing sheet, f. adhering the ends of said loops adjacent said one of said longitudinal edges to said backing sheet, g. cutting one end of each of said loops, and h. removing said core member.

6. A method as in claim 5 and wherein:

said first yarn is a different color than said second yarn.

7. A method as in claim 5 and wherein:

said first yarn has a different texture than said second yarn.

8. A method as in claim 5 and wherein:

said first and second yarns are pre-dyed.

9. Carpeting produced according to the method of claim 5.

10. Bonded pile carpeting including:

a. a backing sheet, b. a plurality of parallel rows of yarn tufts, c. each of said yarn tufts within a row being individual and unconnected to any adjacent tuft, d. each tuft within a row being formed from a single yarn, e. a first preselected portion of the tufts of each row being a first color and a first height, and a second preselected portion of each row linearly immediately adjacent to said first preselected portion being of a second color and a second height different from said first color and said first height.

11. Bonded pile carpeting including:

a. a backing sheet, b. a plurality of parallel rows of yarn tufts, c. each of said yarn tufts within a row being individual and unconnected to any adjacent yarn tuft, d. said rows including a first preselected portion in which each tuft therein is formed from a single first yarn and a second preselected portion in which each tuft is formed from a single second yarn.

12. Carpeting as in claim 11 and wherein:

said first and second yarns are of different colors.

13. Carpeting as in claim 11 and wherein:

the tufts in said first portion have a different height from the tufts in said second portion.

14. Carpeting as in claim 13 and wherein:

said first and second yarns are of different colors.

15. Carpeting as in claim 11 and wherein:

said first and second yarns have different textures.

16. Carpeting as in claim 11 and wherein:

said tufts form pile loops.

17. Carpeting as in claim 11 and wherein:

said tufts have an inverted U-shaped configuration.

18. Carpeting as in claim 11 and wherein:

said tufts have a U-shaped configuration lying substantially in a plane perpendicular to said rows.

* * * * *